US009447766B2

(12) United States Patent
Tanaya

(10) Patent No.: US 9,447,766 B2
(45) Date of Patent: Sep. 20, 2016

(54) IGNITION COIL APPARATUS FOR HIGH-FREQUENCY DISCHARGE

(71) Applicant: Mitsubishi Electric Corporation, Chiyoda-ku, Tokyo (JP)

(72) Inventor: Kimihiko Tanaya, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 355 days.

(21) Appl. No.: 13/788,815

(22) Filed: Mar. 7, 2013

(65) Prior Publication Data

US 2014/0116405 A1 May 1, 2014

(30) Foreign Application Priority Data

Oct. 26, 2012 (JP) ..... 2012-236231

(51) Int. Cl.

| | |
|---|---|
| ***F02P 23/00*** | (2006.01) |
| ***F02P 3/02*** | (2006.01) |
| ***F02P 23/04*** | (2006.01) |
| *F02P 3/04* | (2006.01) |

(52) U.S. Cl.
CPC ..... *F02P 3/02* (2013.01); *F02P 23/04* (2013.01); *F02P 3/04* (2013.01)

(58) Field of Classification Search
CPC ..... F02P 3/02; F02P 23/04; F02P 3/04; H03H 7/0161
USPC ..... 123/594–656; 455/339
See application file for complete search history.

(56) References Cited

U.S. PATENT DOCUMENTS

| | | | | |
|---|---|---|---|---|
| 5,111,790 | A * | 5/1992 | Grandy | F02P 7/035 123/406.14 |
| 7,152,591 | B1 * | 12/2006 | Maeda | F02P 3/04 123/633 |
| 8,225,775 | B1 * | 7/2012 | Idogawa | H01F 27/02 123/634 |
| 8,807,124 | B2 * | 8/2014 | Tanaya | F02P 3/0807 123/605 |
| 8,922,127 | B2 * | 12/2014 | Tanaya | H01T 15/00 315/111.41 |

(Continued)

FOREIGN PATENT DOCUMENTS

| | | | |
|---|---|---|---|
| JP | 2007201084 A | 8/2007 | |
| JP | WO 2010095394 A1 * | 8/2010 | F02P 9/007 |

(Continued)

OTHER PUBLICATIONS

Japanese Office Action Issued Oct. 8, 2013 for application 2012-236231.*

(Continued)

*Primary Examiner* — Thomas Moulis
*Assistant Examiner* — Joshua A Campbell
(74) *Attorney, Agent, or Firm* — Sughrue Mion, PLLC

(57) ABSTRACT

An ignition coil apparatus for high-frequency discharge includes: a primary coil that generates and accumulates a flux; a secondary coil that is magnetically coupled to the primary coil so as to generate a predetermined high voltage when energy of the accumulated flux is released and connected at one end to a high-voltage terminal used to supply energy to an external apparatus; a capacitor that is connected to the high-voltage terminal and prevents passing of the high voltage; and an inductor that, together with the capacitor, allows passing of a predetermined frequency component alone. The primary coil, the secondary coil, the capacitor, and the inductor are installed within a same package.

10 Claims, 3 Drawing Sheets

(56) References Cited

U.S. PATENT DOCUMENTS

| | | | | |
|---|---|---|---|---|
| 2001/0052336 | A1* | 12/2001 | Tanaya | F02P 5/1523 123/406.29 |
| 2003/0005914 | A1* | 1/2003 | Ohkama | F02P 17/12 123/634 |
| 2004/0129241 | A1* | 7/2004 | Freen | F02C 7/266 123/143 B |
| 2005/0252488 | A1* | 11/2005 | Abe | F02P 5/152 123/406.34 |
| 2011/0297131 | A1* | 12/2011 | Nakano | F02P 9/007 123/596 |
| 2013/0148254 | A1 | 6/2013 | Katsuraya et al. | |
| 2014/0116405 | A1* | 5/2014 | Tanaya | F02P 23/04 123/634 |

FOREIGN PATENT DOCUMENTS

| | | | | |
|---|---|---|---|---|
| JP | 2011-99410 | A | 5/2011 | |
| WO | 2010095694 | A1 | 8/2010 | |
| WO | WO 2010095694 | A1 * | 8/2010 | F02P 9/007 |
| WO | 2012032846 | A1 | 3/2012 | |

OTHER PUBLICATIONS

Japanese Office issued Oct. 8, 2013, Patent Application No. 2012-236231.

* cited by examiner

IGNITION COIL APPARATUS FOR HIGH-FREQUENCY DISCHARGE

BACKGROUND OF THE INVENTION

1. Field of the Invention

The present invention relates to an ignition apparatus chiefly used to run an internal combustion engine, and more particularly, to an ignition coil apparatus for high-frequency discharge employed in an ignition apparatus for a spark-ignited internal combustion engine.

1. Background Art

Problems are arising in terms of environmental conservation and depletion of fuel in recent years and it is urgently necessary for the automobile industry to address these problems. As an example of an effort in addressing these problems, there is a method of markedly improving fuel consumption by means of engine downsizing and weight saving with the use of a supercharger.

It is known that in a highly supercharged state, an internal pressure of an engine combustion chamber rises extremely high even when fuel is not burning and it therefore becomes difficult to generate a spark discharge to start combustion. One of the reasons underlying this difficulty is that a required voltage to trigger a breakdown between a high-voltage electrode and a GND electrode (gap) of a spark plug becomes so high that it exceeds a withstanding voltage value of an insulator portion of the spark plug.

A study to increase the withstanding voltage of the insulator portion is being conducted to solve this problem. It is, however, difficult to ensure a withstanding voltage sufficiently high for the required voltage in the actual condition. Under these circumstances, there is no other countermeasure than to narrow a gap spacing of the spark plug.

Narrowing the gap of the spark plug, however, increases influences of an anti-inflammatory action by the electrode portion in turn. Hence, there arises another problem that start-up performance and combustion characteristics become poor.

This problem may be eliminated by avoiding such influences, more specifically, by providing more energy than thermal energy consumed by the anti-inflammatory action, that is, at the electrode portion with a spark discharge or by allowing combustion to take place at the remotest point from the electrode. For example, an ignition apparatus disclosed in Patent Document 1 is proposed.

The ignition apparatus disclosed in Patent Document 1 is an apparatus capable of generating a high-energy spark discharge and forming a discharge plasma spreading in a wider range than that by a normal spark discharge by generating a spark discharge across a spark plug gap using an ignition coil in the related art and by flowing a high-frequency current into a path of the spark discharge via a diode and a mixer.

CITED LIST

Patent Document

Patent Document 1: JP-A-2011-099410

The ignition apparatus in the related art disclosed in Patent Document 1 is to decouple and couple a high voltage system and a high current system using a diode. It is, however, known that lead-free high-voltage diodes are difficult to obtain and not acceptable in terms of mass-productivity. Also, efficiency of the high-voltage diodes is poor because a half-wave of AC energy is cut off.

SUMMARY OF THE INVENTION

The invention is devised to solve the problems of the apparatus in the related art as discussed above and has an object to provide an ignition coil apparatus for high-frequency discharge of a simple configuration that is not only capable of obtaining a high-energy discharge efficiently but also capable of forming a large discharge plasma easily.

An ignition coil apparatus for high-frequency discharge according to an aspect of the invention includes: a primary coil that generates and accumulates a flux when a current is flown; a secondary coil that is magnetically coupled to the primary coil so as to generate a predetermined high voltage when energy of the accumulated flux is released and connected at one end to a high-voltage terminal used to supply energy to an external apparatus; a capacitor that is connected to the high-voltage terminal and prevents passing of the high voltage; and an inductor that is connected to the capacitor and, together with the capacitor, forms a band-pass filter that allows passing of a predetermined frequency component alone. The primary coil, the secondary coil, the capacitor, and the inductor are installed within a same package.

The ignition coil apparatus for high-frequency discharge configured as above is capable of supplying a high AC discharge current between electrodes of a spark plug in fast cycles. Therefore, the ignition coil apparatus for high-frequency discharge is of a simple configuration and not only capable of obtaining a high-energy discharge efficiently but also capable of forming a large discharge plasma. Hence, even when a spark plug with a narrow gap is used, start-up performance and combustion characteristics are not deteriorated. Consequently, it becomes possible to reduce a weight by highly boosted downsizing and to enhance thermal efficiency by making a compression ratio higher. Accordingly, fuel used to run the internal combustion engine can be reduced markedly and an emission of $CO_2$ is reduced considerably. A contribution to environmental conservation can be thus made.

The foregoing and other objects features, aspects, and advantages of the present invention will become more apparent from the following detailed description of the present invention when taken conjunction with the accompanying drawings.

DESCRIPTION OF THE PREFERRED EMBODIMENTS

Figure 1:
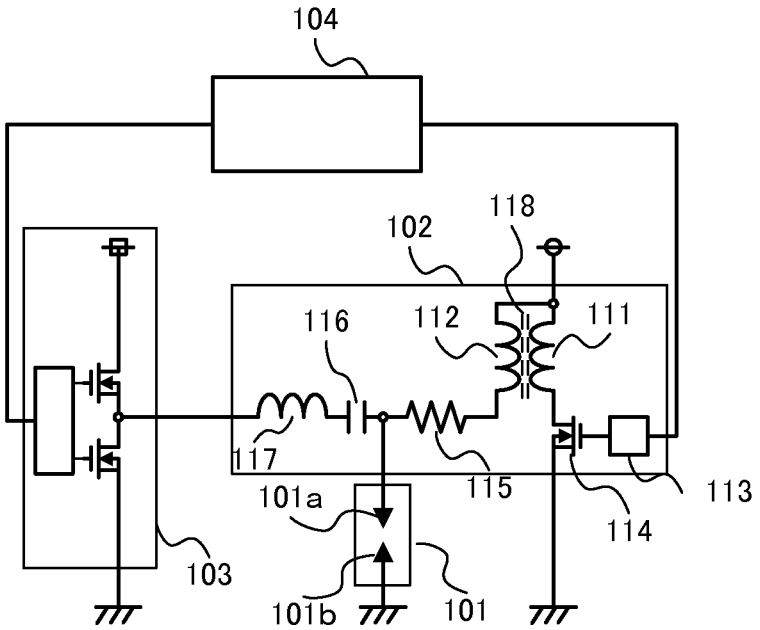
FIG. 1 is a view showing a circuit configuration of a spark-ignited ignition apparatus using an ignition coil apparatus for high-frequency discharge according to a first embodiment of the invention.

Hereinafter, preferred embodiments of an ignition coil apparatus for high-frequency discharge (hereinafter, also referred to simply as the ignition coil apparatus) of the invention will be described with reference to the drawings. Like components are labeled with like reference numerals in the respective drawings.

First Embodiment

An ignition coil apparatus for high-frequency discharge of the invention relates to a spark-ignited ignition apparatus that generates a spark discharge across a main plug gap of a spark plug with a high voltage generated by an ignition coil apparatus and forms a large discharge plasma across the main plug gap by flowing a high-frequency AC current into a path of the spark discharge.

FIG. 1 is a view showing a circuit configuration of a spark-ignited ignition apparatus using the ignition coil apparatus according to a first embodiment of the invention. Referring to FIG. 1, the spark-ignited ignition apparatus using the ignition coil apparatus for high-frequency discharge according to the first embodiment of the invention includes a spark plug 101, an ignition coil apparatus 102 that applies a predetermined high voltage and supplies a high-frequency AC current to the spark plug 101, a high-frequency power supply 103 that supplies high-frequency energy to the ignition coil apparatus 102, and a control apparatus 104 that controls operations of the ignition coil apparatus 102 and the high-frequency power supply 103.

The spark plug 101 includes a high-voltage electrode 101*a* as a first electrode and an outer electrode 101*b* as a second electrode opposing the high-voltage electrode 101*a* with the main plug gas, which is a predetermined interval, in between.

The ignition coil apparatus 102 includes a primary coil 111 and a secondary coil 112 that are magnetically coupled to each other via a core 118, a switching element 114 that controls energization of the primary coil 111, a drive device-A 113 that drives the switching element 114, and a resistance device 115 that suppresses noises of a capacitive discharge system generated when a breakdown is triggered across the main plug gap of the spark plug 101.

The ignition coil apparatus 102 also includes a capacitor 116 and an inductor 117 that together form a band-pass filter that allows a high-frequency current supplied from the high-frequency power supply 103 to pass and blocks a high voltage generated in the secondary coil 112 so as not to be applied to the high-frequency power supply 103.

As is shown in FIG. 1, it is necessary for the band-pass filter to install the inductor 117 on the side of the high-frequency power supply 103 and the capacitor 116 on the side of the spark plug 101. When these components are installed inversely, an extremely high voltage is generated across the inductor 117 and it becomes difficult to design a withstanding voltage of the inductor 117. In addition, because a higher voltage is applied also to the capacitor 116, it also becomes difficult to design a withstanding voltage of the capacitor 116. Further, both the inductor 117 and the capacitor 116 are increased in size. Consequently, mass-productivity becomes poor.

A capacitor with a capacity value smaller than 100 pF is selected as the capacitor 116. The reason underlying this selection is that when a capacitor with a capacity value larger than 100 pF is selected, a high voltage generated across the secondary coil 112 passes through the capacitor 116 and is applied to the inductor 117 and the high-frequency power supply 103. Because a high-voltage capacitor becomes larger as a capacity value increases, a capacitor with a capacity value of about 50 pF is selected in the first embodiment.

One end of the secondary coil 112 is connected to the high-voltage electrode 101*a* of the spark plug 101 via the resistance device 115. One end of the capacitor 116 is directly connected to the high-voltage electrode 101*a* of the spark plug 101.

The resistance device 115 is used to suppress noises and may be omitted in a case where an amount of generated noises is small depending on a structure or a wiring condition of the engine. In this case, one end of the secondary coil 112 is directly connected to the high-voltage electrode 101*a* of the spark plug 101 and one end of the capacitor 116 is also directly connected to the high-voltage electrode 101*a* of the spark plug 101.

By installing the primary coil 111, the secondary coil 112, the capacitor 116, and the inductor 117 within a same package in the ignition coil apparatus 102, a contribution can be made to reducing power consumption by a loss reduction, making the system simpler, reducing the cost, and suppressing noises.

The switching element 114 and the driver device-A 113 may be installed inside the ignition coil apparatus 102 with the purpose to reduce noises and increase efficiency. Alternatively, with the purpose to downsize the engine and lower the gravity center thereof, the switching elements 114 and the driver device-A 113 may be installed on the outside of the ignition coil apparatus 102, for example, inside the control device 104 or inside the high-frequency power supply 103, so that the ignition coil apparatus 102 is reduced in size and weight.

A specific configuration example of the ignition coil apparatus for high-frequency discharge according to the first embodiment of the invention will now be described.

Figure 2A:
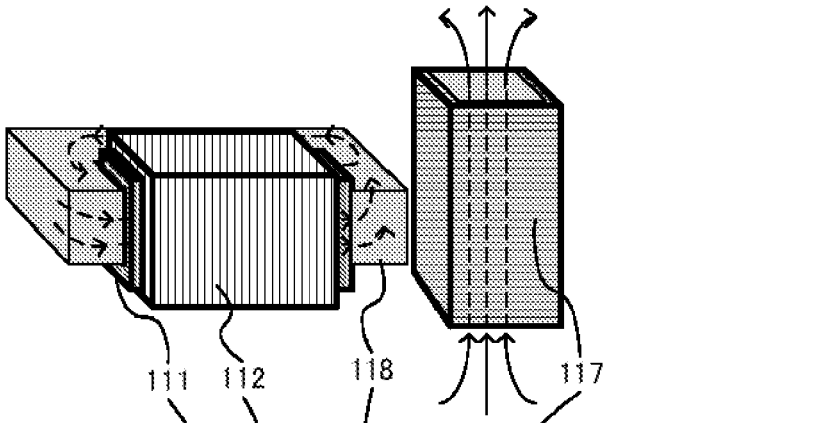
FIGS. 2A and 2B are views showing a specific configuration of the ignition coil apparatus for high-frequency discharge according to the first embodiment of the invention.
Figure 2B:
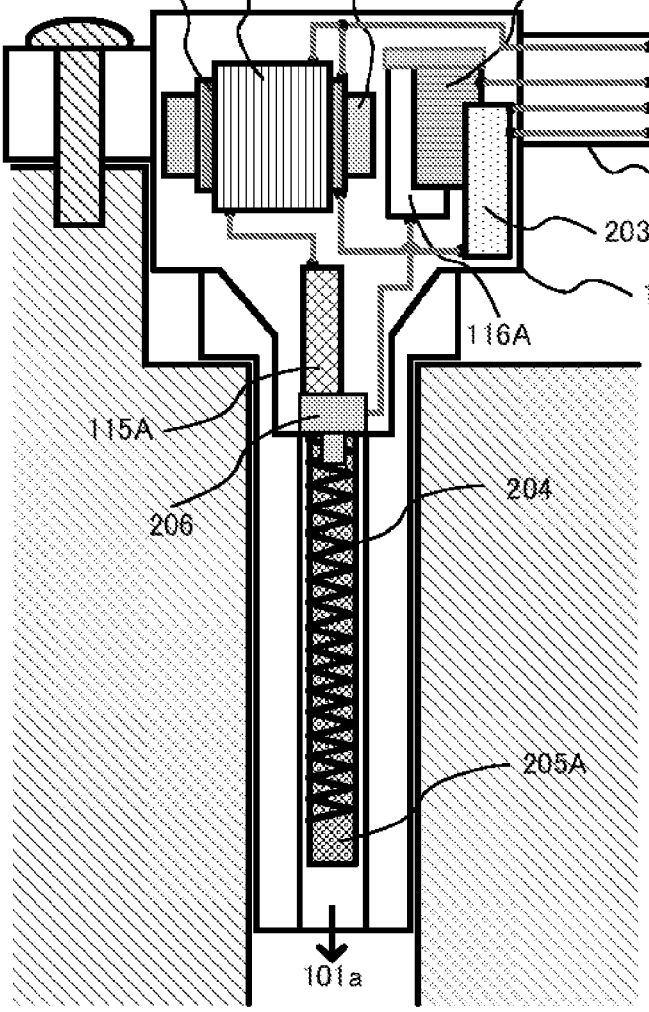

FIGS. 2A and 2B are views used to describe a configuration of the ignition coil apparatus 102 according to the first embodiment of the invention. Referring to FIGS. 2A and 2B, the primary coil 111, the secondary coil 112, the core 118, the capacitor 116A, the inductor 117, the resistance device 115A, a driver device-B 203 are installed inside the ignition coil apparatus 102. The driver device-B 203 is a device formed of the switching element 114 and the driver device-A 113 of FIG. 1 installed within a same package.

A connector portion 201 of FIG. 2B is a connector portion of the ignition coil apparatus 102 and has a battery terminal, a GND terminal, a terminal to be connected to the control device 104, and a terminal to be connected to the high-frequency power supply 103.

One side of the primary coil 111 is connected to the battery terminal and the other side is connected to the GND terminal via the switching element 114 in the driver device-B 203. Also, the switching element 114 in the driver device-B 203 is connected to the driver device-A 113 in the driver device-B 203. The driver device-A 113 is connected to the terminal to be connected to the control device 104 in the connector portion 201.

The primary coil 111 is installed circumferentially about the core 118 and further the secondary coil 112 is wound around the primary coil 111. Owing to this configuration, the primary coil 111 and the secondary coil 112 are brought into a magnetically coupled state.

By forming the core 118 to have so-called a closed magnetic path completely closed or having a clearance as small as about 1 mm, a better magnetically coupled state can be obtained. It thus becomes possible to reduce the number of turns of the primary coil 111 and the secondary coil 112. When configured in this manner, a DC resistance component in the path can be suppressed, and therefore a loss caused by heat generation is reduced and energy can be transmitted efficiently. It thus becomes possible to reduce power consumption of the ignition apparatus. In addition, the closed magnetic path is formed, and by closing the magnetic path, flux energy leaking to the outside can be minimized. Hence, not only does it become possible to transmit energy efficiently, but it also becomes possible to reduce the occurrence of noises and magnetic interference with another apparatus.

One side of the secondary coil 112 is connected to the battery terminal in the connector portion 201 and the other side is connected to one end of the resistance device 115A. The resistance device 115A is inserted into and connected to a terminal 206. The terminal 206 is connected to a spring 204 and a sleeve 205A as well as to one end of the capacitor 116A.

The spring 204 and the sleeve 205A are connected to the high-voltage electrode 101*a* of the spark plug 101. The spring 204 is provided to maintain a connection to the high-voltage electrode 101*a* of the spark plug 101 even in a circumstance where the apparatus moves severely.

The sleeve 205A is provided to maintain a connection to the high-voltage electrode 101*a* of the spark plug 101 even in a circumstance where the apparatus moves severely. Also, the sleeve 205A is furnished with a function of reducing an impedance value (inductance value and DC resistance value) across a path from the resistance device 115A to the high-voltage electrode 101*a* of the spark plug 101. Hence, because the inductance value and the DC resistance value across this path can be reduced, it becomes possible to transmit energy efficiently by reducing a loss caused by heat generation. Consequently, it becomes possible to reduce power consumption of the apparatus.

One side of the inductor 117 is connected to the terminal to be connected to the high-frequency power supply 103 in the connector portion 201 and the other side is connected to the capacitor 116A. The other side of the capacitor 116A is connected to the terminal 206.

A voltage as high as about 10 kV is generated between the inductor 117 and the capacitor 116A and attention should be paid so as not to install a low-potential conductor near these components. The ignition coil apparatus 102 may be downsized by installing the inductor 117 on the outside of the ignition coil apparatus 102. In this case, however, it becomes difficult to secure a withstanding voltage of the connector portion 201 and a special connector is required. Hence, it is highly likely that the costs of the ignition coil apparatus 102 are increased. In view of this inconvenience, the apparatus of the first embodiment is configured in such a manner that both the inductor 117 and the capacitor 116A are installed inside the ignition coil apparatus 102 and insulating treatment is applied using an epoxy material filled therein.

Also, by installing the inductor 117 so as to hardly magnetically interfere with the primary coil 111 and the secondary coil 112, it becomes possible to stabilize the apparatus performance and upgrade the quality. More specifically, the inductor 117 is installed in such a manner that fluxes generated from the conductor 117 and the primary and secondary coils 111 and 112 are not oriented parallel to each other. For example, as is shown in FIG. 2A, the inductor 117 is installed so that the fluxes are oriented perpendicularly to each other.

By using a hollow core or a core of an open magnetic path type as the inductor 117, the ignition coil apparatus 102 can be downsized. The reason underlying this downsizing is as follows. That is, because a high-frequency AC current of about several amperes flows through the inductor 117, magnetic saturation readily occurs in a core of a closed magnetic path type. When an allowance is made to prevent magnetic saturation, a huge core becomes necessary. Naturally, the ignition coil apparatus 102 enclosing such a huge core is increased in size.

As has been described, the ignition coil apparatus for high-frequency discharge according to the first embodiment of the invention is of a simple and compact configuration and not only capable of obtaining a high-energy discharge efficiently but also capable of forming a large discharge plasma. Hence, even when a spark plug with a narrow gap is used, start-up performance and combustion characteristics are not deteriorated. Consequently, it becomes possible to reduce a weight by highly boosted downsizing and to enhance thermal efficiency by making a compression ratio higher.

Accordingly, fuel used to run the internal combustion engine can be reduced markedly and an emission of $CO_2$ is reduced considerably. A contribution to environmental conservation can be thus made.

Second Embodiment

An ignition coil apparatus for high-frequency discharge according to a second embodiment of the invention will now be described. In the first embodiment above, the resistance device 115A and the capacitor 116A are installed on the outside of a plug hole. On the contrary, in the second embodiment, these resistance device and capacitor are installed inside the plug hole so that radiation noises can be suppressed further.

Figure 3:
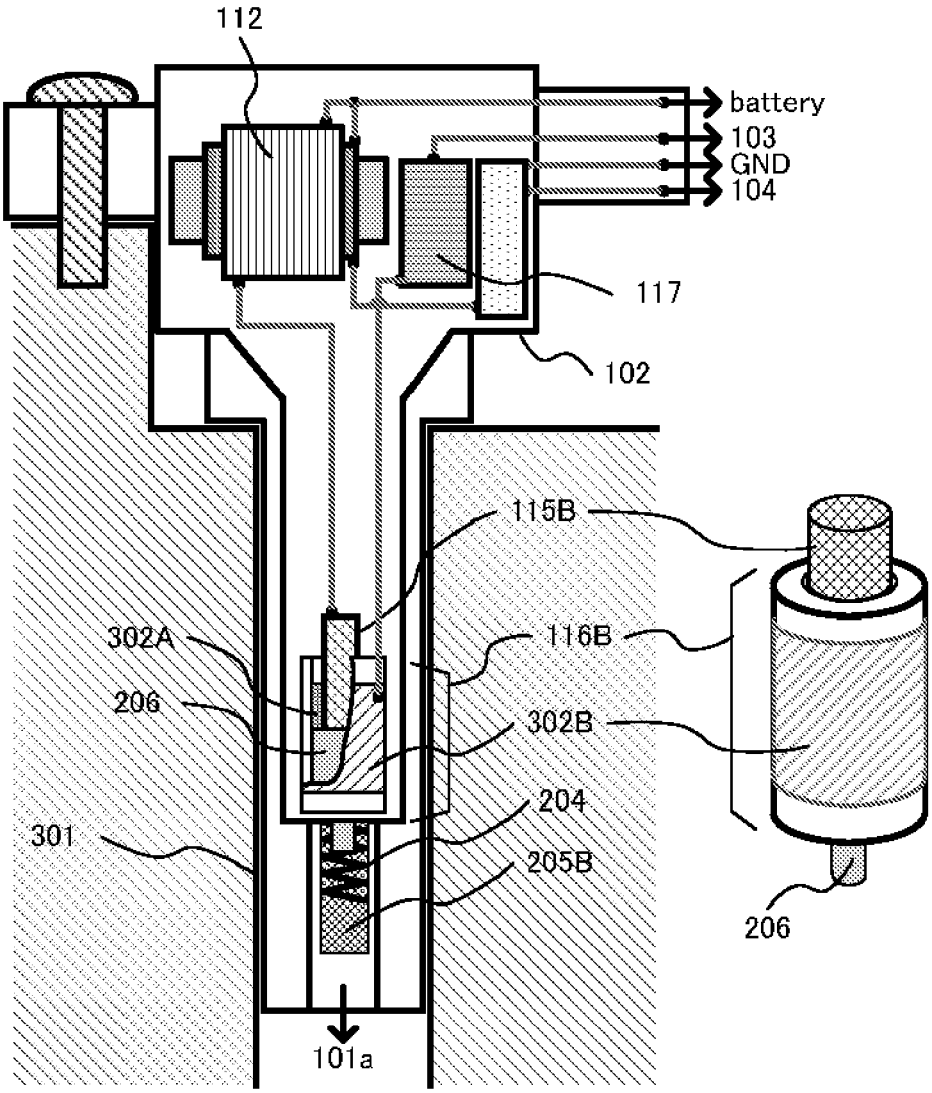
FIGS. 3A and 3B are views showing a specific configuration of an ignition coil apparatus for high-frequency discharge according to a second embodiment of the invention.

FIGS. 3A and 3B are views showing a configuration of an ignition coil apparatus 102 for high-frequency discharge according to the second embodiment of the invention.

Referring to FIGS. 3A and 3B, because the circuit configuration and the components installed inside the ignition coil apparatus 102 are the same as those in the first embodiment above, the description will not be repeated and only a difference will be described in detail.

In the second embodiment, as is shown in FIG. 3A, a resistance device 115B and a capacitor 116B are installed inside a plug hole 301.

The capacitor 116B is of a cylindrical shape as is shown in FIG. 3B. One end of an electrode is an inner surface 302A of the cylinder and the other end is an outer surface 302B of the cylinder.

One end of the resistance device 115B is connected to the secondary coil 112 and the other end is inserted into a terminal 206 and electrically connected to the terminal 206. The terminal 206 is inserted into the cylinder forming the capacitor 116B and electrically and physically comes into contact with the electrode 302A on the inner surface. In addition, the terminal 206 is installed so as to also come into contact with a spring 204 and a sleeve 205B.

The electrode 302B on the outer surface of the cylinder, which is an electrode at the other end of the capacitor 116B, is connected to the inductor 117 and therefore connected further to the high-frequency power supply 103.

The configuration as above can shorten a path through which to flow a current of a capacitive discharge system as a noise source to a shortest length. Also, by keeping the path inside the plug hole 301, it becomes possible to prevent leakage of noises to the outside of the engine.

As has been described, the ignition coil apparatus for high-frequency discharge according to the second embodiment of the invention is of a simple and compact configuration and not only capable of obtaining a high-energy discharge efficiently but also forming a large discharge plasma while reducing radiation noises. Hence, even when a spark plug with a narrow gap is used, start-up performance and combustion characteristics are not deteriorated. Consequently, it becomes possible to reduce a weight by highly boosted downsizing and to enhance thermal efficiency by making a compression ratio higher.

Accordingly, fuel used to run the internal combustion engine can be reduced markedly and an emission of $CO_2$ is reduced considerably. A contribution to environmental conservation can be thus made.

The ignition coil apparatus for high-frequency discharge of the invention is mounted on an automobile, a motorcycle, an outboard engine, and other special machines using an internal combustion engine and ignites fuel in a reliable manner to run the internal combustion engine efficiently. Hence, the ignition coil apparatus for high-frequency discharge of the invention is useful in solving a fuel depletion problem and in conserving the environment.

Various modifications and alterations of this invention will be apparent to those skilled in the art without departing from the scope and spirit of this invention, and it should be understood that this is not limited to the illustrative embodiments set forth herein.

What is claimed is:

1. An ignition coil apparatus for high-frequency discharge, comprising:

a primary coil that generates and accumulates a flux when a current is flown;

a secondary coil that is magnetically coupled to the primary coil so as to generate a predetermined high voltage when energy of the accumulated flux is released and connected at one end to a high-voltage terminal used to supply energy to an external apparatus;

a capacitor and an inductor that are connected in series with each other and constitute a band-pass filter that is connected between a high-frequency power supply and the high-voltage terminal, passes therethrough a high-frequency current supplied from the high-frequency power supply, and blocks off the high voltage generated by the secondary coil so as to prevent the high voltage from being applied to the high-frequency power supply, wherein one end of the inductor is connected to the high-frequency power supply side and another end of the inductor is connected to one end of the capacitor, wherein another end of the capacitor is connected to the high-voltage terminal, and wherein the primary coil, the secondary coil, the capacitor, and the inductor are installed within a same package.

2. An ignition coil apparatus for high-frequency discharge, comprising:

a primary coil that generates and accumulates a flux when a current is flown;

a resistor that is used to suppress radiation noises;

a secondary coil that is magnetically coupled to the primary coil so as to generate a predetermined high voltage when energy of the accumulated flux is released and connected at one end via the resistor to a high-voltage terminal used to supply energy to an external apparatus; a capacitor and an inductor that are connected in series with each other and constitute a band-pass filter that is connected between a high-frequency power supply and the high-voltage terminal, passes therethrough a high-frequency current supplied from the high-frequency power supply, and blocks off the high voltage generated by the secondary coil so as to prevent the high voltage from being applied to the high-frequency power supply, wherein end of the inductor is connected to the high-frequency power supply side and another end of the inductor is connected to one end of the capacitor, wherein another end of the capacitor is connected to the high-voltage terminal, and wherein the primary coil, the secondary coil, the capacitor, the inductor, and the resistor are installed within a same package.

3. The ignition coil apparatus for high-frequency discharge according to claim 1, wherein the inductor is installed in such a manner that a flux thereof and fluxes of the primary coil and the secondary coil are not oriented parallel to each other.

4. The ignition coil apparatus for high-frequency discharge according to claim 2, wherein the inductor is installed in such a manner that a flux thereof and fluxes of the primary coil and the secondary coil are not oriented parallel to each other.

5. The ignition coil apparatus for high-frequency discharge according to claim 1, wherein the capacitor is set to have a capacitance of 100 pF or below.

6. The ignition coil apparatus for high-frequency discharge according to claim 2, wherein the capacitor is set to have a capacitance of 100 pF or below.

7. The ignition coil apparatus for high-frequency discharge according to claim 1, further comprising:

a spring that is connected to the high-voltage terminal and used to maintain a contact with the external apparatus; and a sleeve that is installed so as to cover the spring and used not only to maintain a contact with the external apparatus but also to reduce an impedance across a path from the high-voltage terminal to the external apparatus.

8. The ignition coil apparatus for high-frequency discharge according to claim 2, further comprising:

a spring that is connected to the high-voltage terminal and used to maintain a contact with the external apparatus; and a sleeve that is installed so as to cover the spring and used not only to maintain a contact with the external apparatus but also to reduce an impedance across a path from the high-voltage terminal to the external apparatus.

9. The ignition coil apparatus for high-frequency discharge according to claim 1, wherein the capacitor is installed to fit within a plug hole of the engine to which the ignition coil apparatus for high-frequency discharge is attached.

10. The ignition coil apparatus for high-frequency discharge according to claim 2, wherein one or both of the capacitor and the resistor are installed to fit within a plug hole of the engine to which the ignition coil apparatus for high-frequency discharge is attached.

* * * * *